US006863342B2

(12) United States Patent
Floyd, Jr.

(10) Patent No.: US 6,863,342 B2
(45) Date of Patent: Mar. 8, 2005

(54) AIR CONDITIONED BENCH

(75) Inventor: Franklin B. Floyd, Jr., Shaker Heights, OH (US)

(73) Assignee: Reliable Construction Construction Heaters, Incorporated, Cleveland, OH (US)

( * ) Notice: Subject to any disclaimer, the term of this patent is extended or adjusted under 35 U.S.C. 154(b) by 57 days.

(21) Appl. No.: 10/150,367

(22) Filed: May 16, 2002

(65) Prior Publication Data

US 2002/0175541 A1 Nov. 28, 2002

Related U.S. Application Data

(63) Continuation-in-part of application No. 10/045,244, filed on Nov. 9, 2001, which is a continuation-in-part of application No. 09/716,007, filed on Nov. 17, 2000, now Pat. No. 6,435,608.

(60) Provisional application No. 60/166,607, filed on Nov. 19, 1999.

(51) Int. Cl.[7] ..... A47C 7/74

(52) U.S. Cl. ..... 297/180.11; 297/180.13; 297/452.43; 297/452.46

(58) Field of Search ..... 297/180.11, 180.13, 297/180.14, 452.46, 452.43, 452.47

(56) References Cited

U.S. PATENT DOCUMENTS

| | | | | |
|---|---|---|---|---|
| 3,948,246 A | | 4/1976 | Jenkins | |
| 4,134,615 A | | 1/1979 | Jenkins | |
| 4,225,774 A | | 9/1980 | Taberman | |
| 4,226,363 A | | 10/1980 | Sheldon | |
| 4,307,701 A | | 12/1981 | Balon et al. | |
| 4,509,792 A | | 4/1985 | Wang | |
| 4,545,379 A | | 10/1985 | Jenkins | |
| 4,556,254 A | * | 12/1985 | Roberts | 297/452.46 |
| 4,676,223 A | | 6/1987 | Peterson | |
| 4,840,115 A | | 6/1989 | Johnson et al. | |
| 4,981,324 A | | 1/1991 | Law | |
| 5,125,238 A | | 6/1992 | Ragan et al. | |
| 5,360,374 A | | 11/1994 | Wyon et al. | |
| 5,404,865 A | | 4/1995 | Huls | |
| 5,416,935 A | | 5/1995 | Nieh | |
| 5,613,729 A | * | 3/1997 | Summer, Jr. | 297/180.11 X |
| 5,715,695 A | | 2/1998 | Lord | |
| 6,511,125 B1 | * | 1/2003 | Gendron | 297/180.11 |

FOREIGN PATENT DOCUMENTS

| | | | | |
|---|---|---|---|---|
| JP | 04092607 A | * | 3/1992 | A47C/7/74 |

* cited by examiner

*Primary Examiner*—Anthony D. Barfield
(74) *Attorney, Agent, or Firm*—Calfee, Halter & Griswold LLP

(57) ABSTRACT

A seating device having an air conditioning unit fluidly connected to a substantially hollow air diffuser. The air diffuser has a plurality of apertures through which cold air generated by the air conditioning unit is exhausted. The air diffuser serves as a back rest for the seating device. The air diffuser sits in a channel defined by the back surface of the seating member of the seating device, the horizontal support member on an L-shaped support bracket, and the front surface of the vertical braces of the L-shaped support bracket.

15 Claims, 9 Drawing Sheets

AIR CONDITIONED BENCH

RELATED APPLICATION

This application is a continuation-in-part of pending U.S. patent application Ser. No. 10/045,244 filed on Nov. 9, 2001 for a SEATING DEVICE HAVING A HELMET HEATING RACK, the entire disclosure of which is fully incorporated herein by reference, which is a continuation-in-part of U.S. patent application Ser. No. 09/716,007 filed on Nov. 17, 2000 now U.S. Pat. No. 6,435,608, for a SEATING DEVICE, which claims the benefit of U.S. Provisional patent application Ser. No. 60/166,607 filed on Nov. 19, 1999 for a SEATING DEVICE, the entire disclosures of which are fully incorporated herein by reference.

FIELD OF THE INVENTION

The subject invention relates generally to devices designed to warm or cool persons participating in activities in extreme temperature conditions. More particularly, the invention relates to seating devices useful for warming or cooling the bodies and equipment of participants in hot or cold weather athletic events such as football practices and games.

BACKGROUND OF THE INVENTION

The desire to provide a heat source for those observers or participants in athletic events who are not actively engaged in the athletic contest—coaches, substitute players, the offensive or defensive squads that are alternatively on the sideline or on the playing field, etc.—has led to the development and use of various personnel warming devices. Known warmers include torpedo heaters and other space heaters designed to blow hot air into a general area, heated benches for seating, and heated bench-like structures that can be used as seats or that otherwise serve as radiant sources of heat. The present invention represents an improvement to known heated benches and bench-like structures, as it is a more effective and comfortable means of warming the entire body of a person who is required or desires to sit or stand for long periods of time in a cold environment.

Known heated benches have not been designed to be effective and convenient total body warmers. For example, U.S. Pat. No. 3,948,246 to Jenkins discloses a bench wherein heated air under pressure is moved from a heating source through a conduit and into a mostly hollow bench structure. The Jenkins bench is perforated in multiple locations, thus providing necessary outlets for exhausting the pressurized air, and also creating streams of heated air blowing onto whoever is sitting on the bench. However, neither Jenkins nor any other known bench is effectively able to route this exhausted air so that it envelopes the entire body of the sitter(s) without the use of flexible hoses extending from the bench. The known benches are only effective when sat upon, and even then their effectiveness is limited to warming only the backside of the sitters. So in addition to only heating one side of the body, these benches also essentially deprive a person of the option of standing if that person wishes to experience any warmth at all.

In addition to the shortcomings discussed above, known heated benches do a particularly poor job of warming a person's feet. Jenkins provides for a compartment at the back of the bench into which the feet may be inserted, and U.S. Pat. No. 4,134,615, also to Jenkins, provides a bench that requires a person to pull his lower legs and feet back into a compartment located in the front of the bench. In the first scenario, a person cannot warm his feet while simultaneously warming the rest of his body, because foot warming requires that the person stand behind the bench. In the second scenario, a person must sit uncomfortably to warm his feet.

Cylindrical bench-like structures, like that disclosed in U.S. Pat. No. 4,676,223 to Huls, have also been used as heat sources for participants at outdoor athletic events. The Huls device operates on many of the same basic principles as do the heated benches, but lacks the advantage of providing a back support for anyone wishing to sit upon the device. This device has been equipped with perforations for exhausting hot air at regular intervals along the length and circumference of the device, however, making standing near the device more of an option than it is with a heated bench. But the person standing near the device will not be fully enveloped in heated air, thereby leaving the side of his or her body facing away from the device exposed to the cold. Another disadvantage is that one cannot sit on the device and simultaneously warm his feet. Foot warming requires that the person face the cylindrical heater, standing with his toes beneath the drum.

Providing a heat source for participants in cold-climate athletic events not only makes exposure to cold temperatures more bearable from a comfort standpoint, it also enhances the performance and safety of the participants in such conditions. For example, warm muscles are more limber and less prone to injury than are muscles that become tight as a result of inactivity in cold temperatures. Moreover, in contact sports such as football, the force of a collision is less painful—and potentially less injurious—to a warm body.

Minimizing the risk of injury is obviously important in any activity, regardless of climate. And protecting the head is particularly important in activities where the potential for head trauma is high. As a result, helmets are often mandatory or highly recommended equipment for participation in such activities. Logically, maintaining a helmet in its optimal condition helps optimize the helmet's effectiveness. It has been observed, however, that when a helmet is exposed to cold temperatures, its padding can be adversely affected, and the helmet's effectiveness can be compromised.

A helmet's padding serves the dual purpose of absorbing the force of a blow to the helmet and ensuring that the helmet fits its wearer properly. To do this consistently, the padding must be able to maintain its elasticity in all conditions and circumstances. But when cold, the padding hardens. When its pads harden, a helmet becomes difficult to put on, and more importantly, the helmet's ability to protect the head is compromised. Instead of absorbing the force of a blow to the helmet, the hardened pads become an instrument through which the force is delivered to the head. The helmet's wearer is thereby exposed to a greater risk of head injury.

Heat radiating from a player's head generally keeps the padding in his helmet from hardening in cold temperatures. But it is not always practical or desirable for a football player to wear his helmet when not participating in the game or practice. In addition to the padding of his helmet hardening, a secondary problem often arises when a player removes his helmet—the player frequently forgets where he placed it when he took it off.

It is therefore an objective of this invention to provide an apparatus which effectively heats the interior padding of helmets or other equipment, while providing a structure for the convenient placement of such equipment.

It is another objective of this invention to provide an efficient and effective heating system for warming the entire body of a person required or desiring to sit or stand for extended periods in a cold environment.

Conversely, many athletic events take place in extremely warm environments. In such conditions, it is important to protect athletes from overheating. Overheating can result in dehydration, heat stroke, or even death. In addition to providing water to athletes, cooling devices have also been employed to keep athletes' body temperatures from rising to dangerous levels. Such devices include fans, fans that blow cool mist into open air, and portable air conditioning units that blow cool air into open spaces. These devices have not been effectively used in connection with seating devices to efficiently deliver cool air to athletes seated upon them.

It is an objective of one embodiment of this invention to provide a bench structure upon which an athlete may comfortably sit and be effectively cooled in high temperature environments.

SUMMARY OF THE INVENTION

According to one embodiment, the invention provides a seating device or a personnel warming system having an improved heated bench in combination with a heated deck which extends from a base of the footwall of the bench. A person may either sit on the bench with his feet resting on the deck in front of him, or he may stand on the deck itself. In either case, the invention effectively provides heat to the person's entire body, especially including the feet.

The bench is a substantially hollow structure that is warmed by heated air that is forced into an interior space defined by the bench. The entire outer surface of the bench is warmed by this process. The heated pressurized air is exhausted from the interior space of the bench and into a substantially hollow deck which extends outwardly from the base of the footwall of the bench. The deck has perforations in its top surface through which the heated, pressurized air is exhausted from the bench.

The bench configuration described above takes maximum advantage of the hot air that is exhausted from the heating system, creating a zone of hot air directly in front of the bench and above its deck that is sufficiently large enough to heat the front side of a person sitting on the bench. While sitting on the bench, a person's feet would be resting comfortably on the heated deck in front of him, keeping his feet warm and placing his lower legs in the path of the exhausted hot air. Moreover, the front side of the person's upper torso would also be in the zone of heated air.

The present invention also provides a person with the option of standing on the deck and still experiencing full body warmth. The zone of heated air originating from the perforations in the top surface of the deck extends high enough to fully envelope a person that is standing on the deck. The deck is an especially effective heating source when the person standing on it is wearing a parka or other long overgarment that is open at its bottom. In this situation, the hot air rising from the deck fills the interior space defined by the garment worn by the person standing over the exhaust. In the case of a parka worn in conjunction with the use of the present invention, the garment will retain its designed shape and the hot air exhausted from the deck is essentially trapped within the garment, providing additional warmth for the wearer. As the use of parkas is common among football teams, this is a significant advantage.

The present invention contemplates, in one embodiment, a seating device having a heated helmet rack. The seating device comprises a bench fluidly connected to an air source, the bench having a frontal wall, a deck, and defining an interior space. The bench receives air from the air source into its interior space and exhausts the air through perforations in the frontal wall into the deck. The deck defines an interior space into which the air is received. The deck has a top surface and extends from the frontal wall of the bench. The air is exhausted from the deck through perforations in its top surface. The seating device also has a rack structure comprising a heating element, a duct having a plurality of substantially hollow posts, each of the posts having a terminal support, and each terminal support having at least one opening.

Another aspect of the heating rack is that the heating element be an electric heater or the air source of the bench. In an embodiment where the heating element is the air source, the heating rack is attached to the bench by a series of hollow connectors which allow the air received into the bench from the air source to be exhausted out of the bench through the connectors and into the duct. In accordance with another aspect of this embodiment of the invention, the bench and the heating rack comprise a unibody construction comprised of injection-molded fiberglass.

The present invention contemplates, in another embodiment of the invention, a rack for heating helmets and other equipment comprising a heating element fluidly connected to a duct, the duct having a plurality of hollow posts, each of the posts having a terminal support, and each terminal support having a top surface and at least one opening. In accordance with one aspect of the invention, the heating element is an electric heater; in accordance with another aspect of the invention, the heating element is a substantially hollow bench into which heated air is received from an air source, and to which the rack is mounted.

In accordance with another aspect of the invention, the top surface of the terminal support is dome-shaped. The terminal support can be comprised of a cap having a diameter of 4 to 4.5 inches and a height of 4 to 4.5 inches.

In accordance with another aspect of the invention, the duct comprises a linear arrangement of a plurality of duct sections and tee connectors; a post is joined to the duct at each tee connector. The rack may also comprise a plurality of support structures that allow the rack to be mounted on vertical or horizontal surfaces, or to be a free-standing device.

In accordance with another aspect of the invention, the rack comprises a unibody injection-molded construction having either an electric heater or a substantially hollow bench into which heated air is received from an air source as its heating element.

A benefit of the present invention is that it prevents the padding in football or other helmets from hardening in cold temperatures. Another benefit of the present invention is that its rack framework provides a structure for the convenient placement of helmets, therefore making it easier for a player to locate his own helmet when it is needed.

The present invention also contemplates, in accordance with another aspect of the invention, an air conditioning unit fluidly connected to a substantially hollow air diffuser which serves as a back rest for a bench. Cool air is exhausted through a plurality of apertures located in the front surface of the air diffuser. The bench defines a channel in which the bottom portion of the air diffuser sits. The channel is formed by the back surface of the seating member of the bench, the horizontal support member of an L-shaped bracket, and the front surface of the vertical braces of the L-shaped support bracket. A benefit of the present invention is that it provides an easily assembled device which in turn provides a source of cool air to those who sit comfortably on the seat.

Other objects and advantages of the present invention will be apparent from the drawings and detailed discussions presented below.

DETAILED DESCRIPTION OF THE INVENTION

Figure 1A:
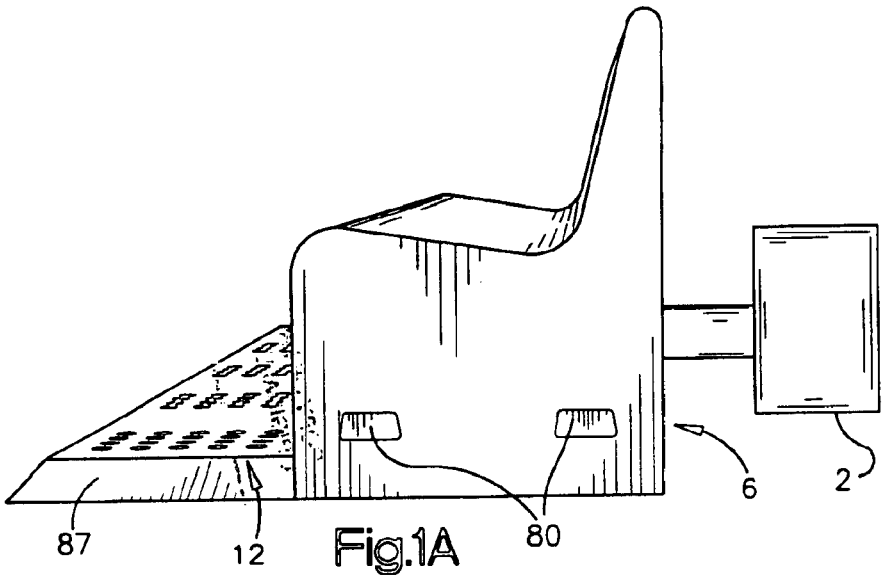
FIG. 1A is a perspective side view of an embodiment of the present invention.
Figure 1B:
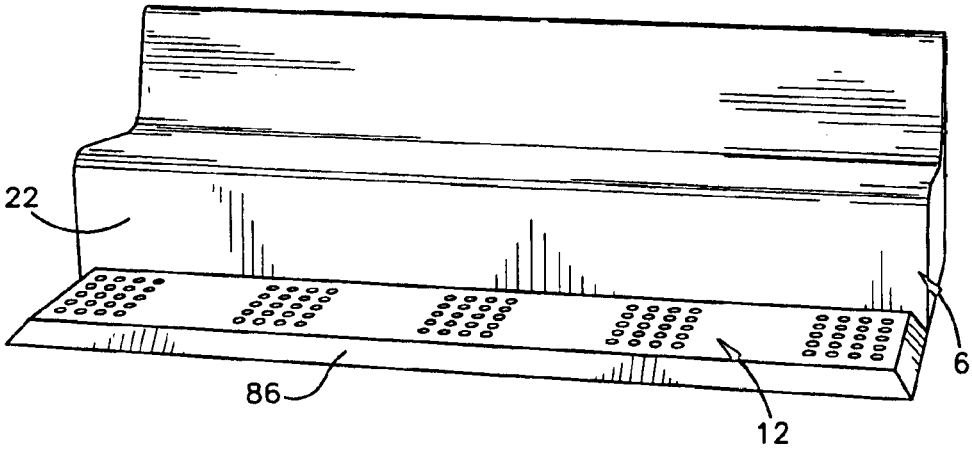
FIG. 1B is a perspective front view of an embodiment of the present invention.
Figure 1C:
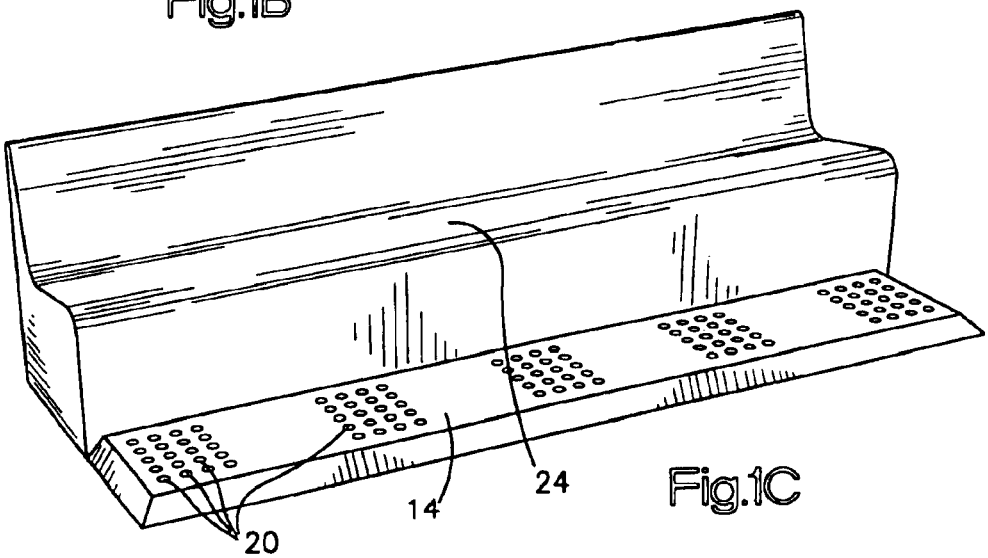
FIG. 1C is a perspective top view of an embodiment of the present invention.
Figure 1D:
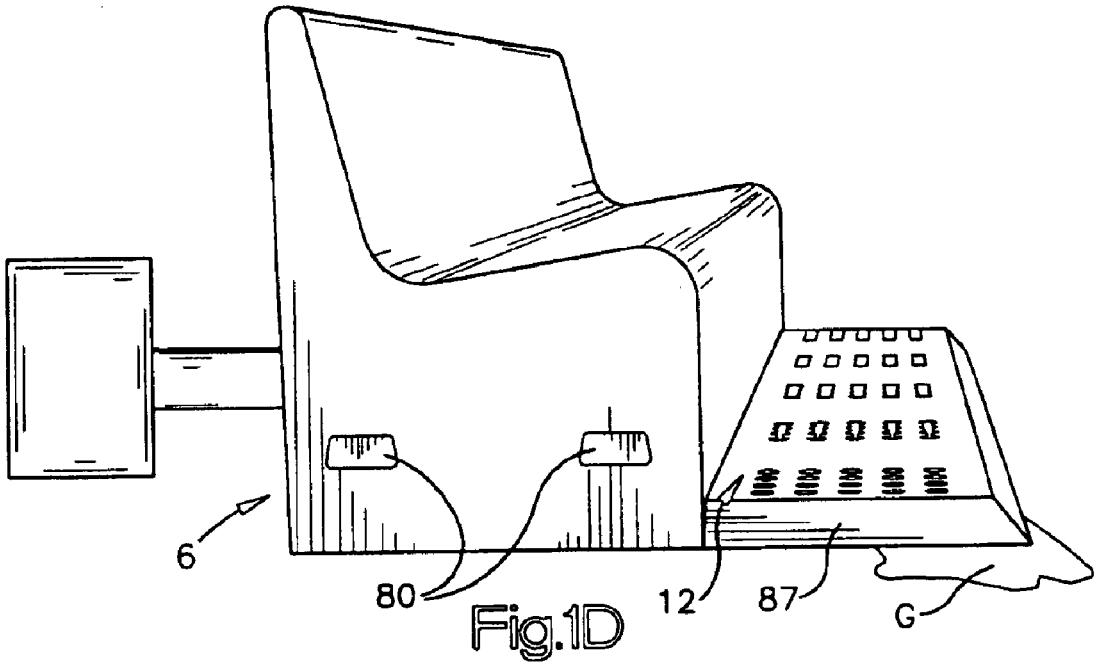
FIG. 1D is a perspective side view of an embodiment of the present invention, illustrating the opposing side view of the device as that illustrated in FIG. 1A.

Referring to FIGS. 1A–1E, the inventive heated bench/deck combination is a seating device or a personnel warming system comprised of a bench 6 defining an interior space 8 bordered by the internal surface 11 of the bench and a substantially hollow deck 12, which when the invention is in operation, extends outwardly from a base 9 of the front wall portion or footwall 22 of the bench. The footwall 22 is defined herein as the substantially vertical portion at the front of the bench, against which the back of the lower legs of a person sitting on the bench would rest. The footwall 22 runs in a substantially vertical direction from the seating surface 24 of the bench to at least the top surface 14 of the deck, and possibly to the base of the bench, depending on the embodiment of the invention. The seating surface 24 of the bench is defined herein as the substantially horizontal portion of the bench against which generally the buttocks and upper legs of a sitting person would rest.

The interior space 8 of the bench is designed to receive heated pressurized air. This air is produced by a heat source 2. The heat source 2 may be located within the interior space 8 of the bench or it may be external to the bench, as illustrated. Where the heat source 2 is external to the bench, the heated, pressurized air is forced into the interior space 8 of the bench through an inlet conduit 4 that is fluidly connected to the heat source 2 and the bench 6 in the direction of the illustrated arrow. The heat source 2 can be any hot air generating device including, but not limited to, combustion heaters or electric resistance heaters. The heat source 2 may or may not be self-contained. It is preferred that the heat source 2 be a combustion heater fueled by natural gas.

Figure 1E:
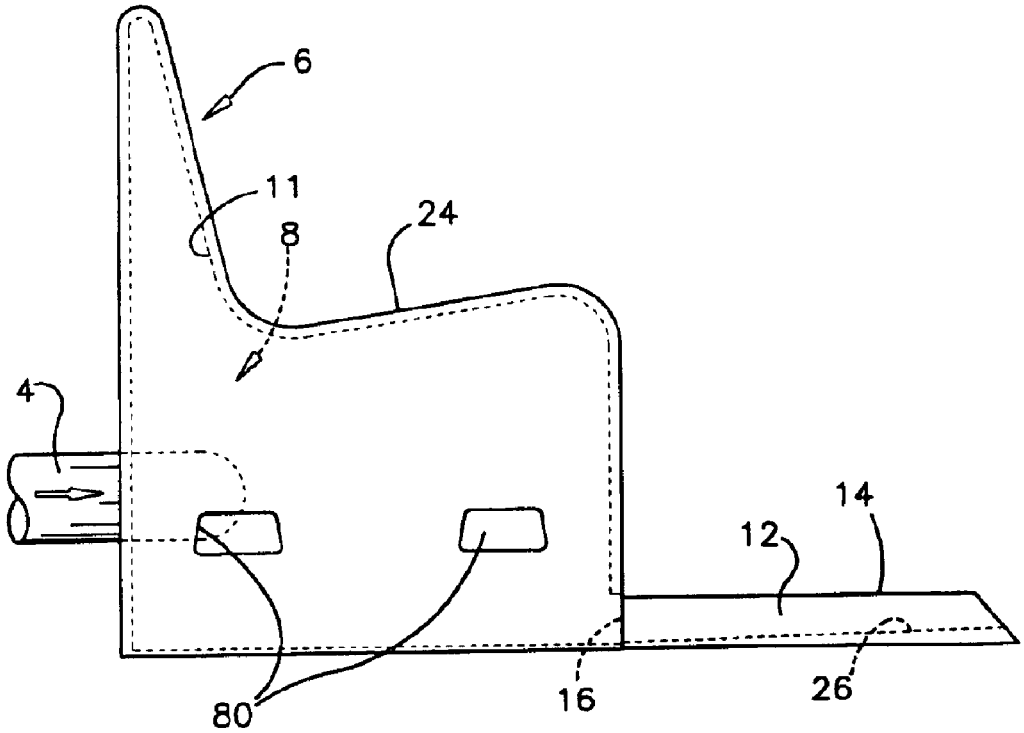
FIG. 1E is a side view of an embodiment of the invention, illustrated with the deck extending from the base of the footwall of the bench.
Figure 2:
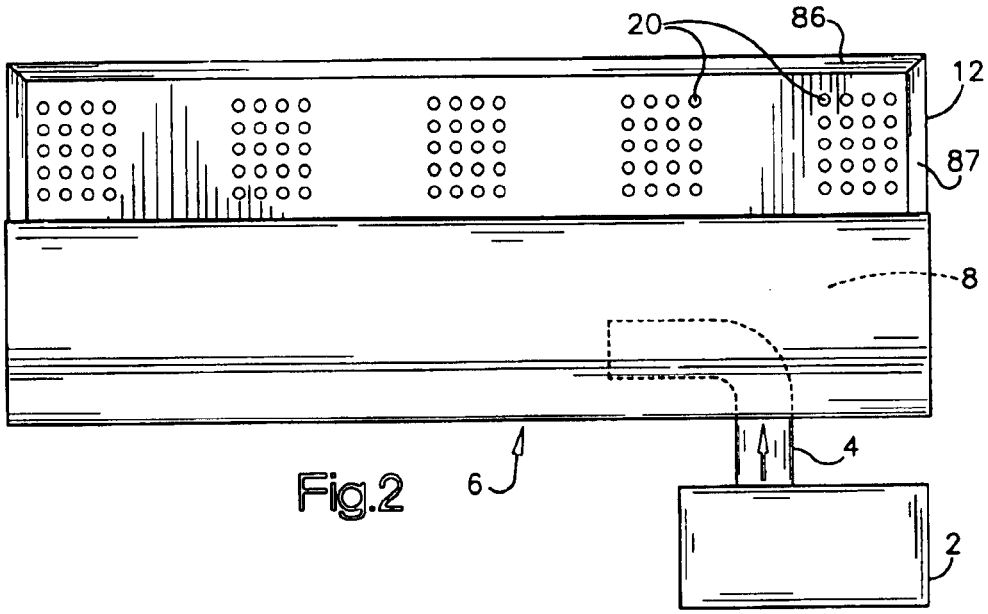
FIG. 2 is a top view of the an embodiment of the invention illustrated with the deck extending from the base of the footwall of the bench.
Figure 3:
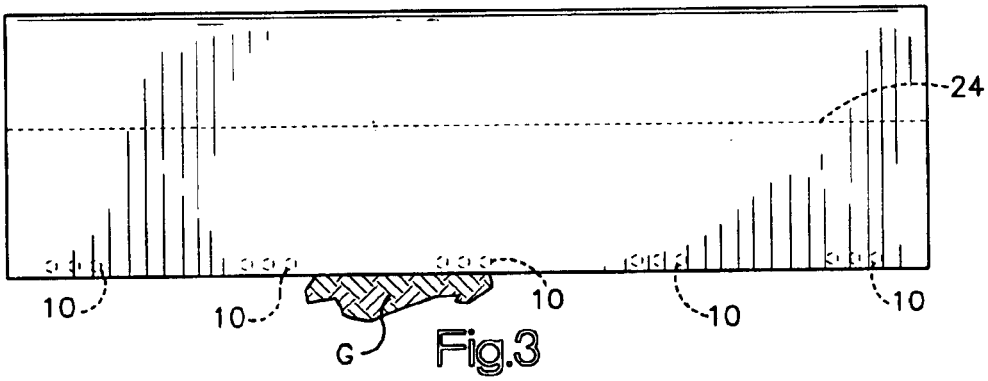
FIG. 3 is a backview of an embodiment of the invention.
Figure 7:
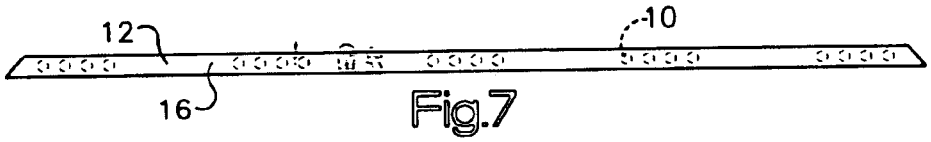
FIG. 7 is a back view of an embodiment of the deck portion of the invention.
Figure 8:
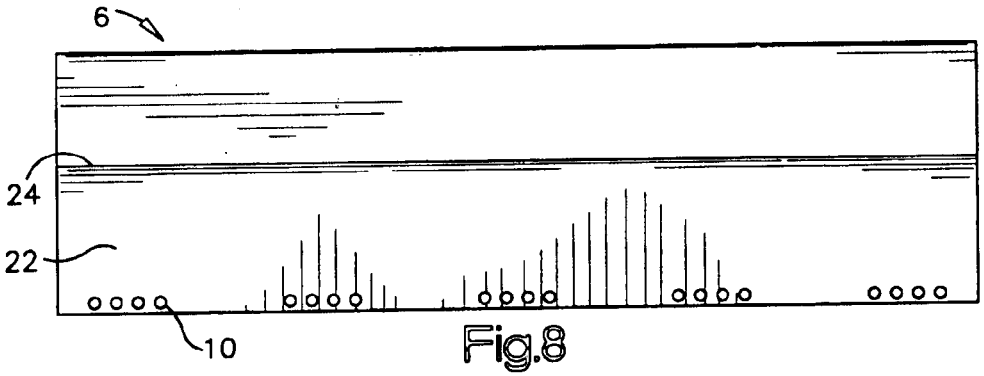
FIG. 8 is a front view of an embodiment of the bench portion of the invention.
Figure 9:
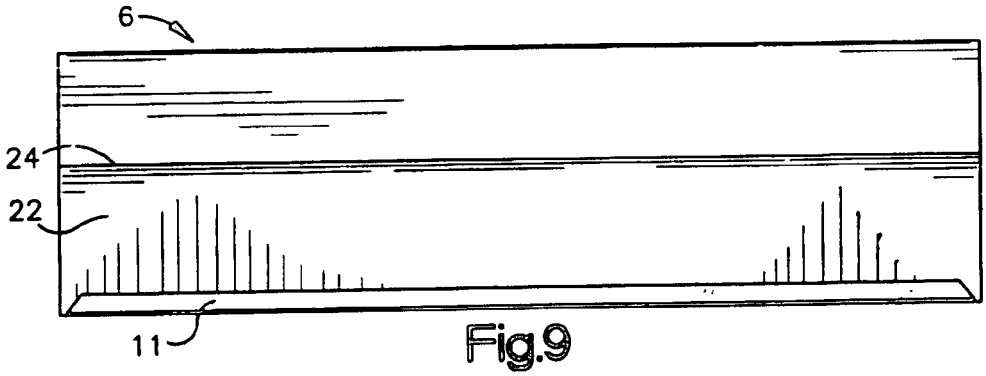
FIG. 9 is a front view of an embodiment of the bench portion of the invention.

The heated pressurized air forced into the interior space 8 of the bench must be exhausted out of the warming system. This exhaustion is accomplished through perforations 10 in either the footwall 22, as shown in FIG. 8, or the back wall 16 of the deck, as shown in FIG. 7. The structure in which the perforations 10 are located depends upon the particular embodiment of the invention. Regardless of the structure in which the perforations 10 are technically located, when the invention is in operation, the perforations 10 will be, as illustrated, in an otherwise continuous wall that runs from the base of the bench to the seating surface 24 and that occupies the same plane as the footwall 22. This continuous wall is referred to hereinafter as the frontal wall 28. FIG. 1E illustrates an embodiment of the frontal wall 28 wherein the frontal wall 28 is comprised of a combination of the footwall 22 and the back wall 16 of the deck 12. FIG. 8 illustrates how the frontal wall 28 could be comprised entirely of the footwall 22. FIGS. 7 and 9 illustrate the separate bench 6 and deck 12 structures that might be combined to form the frontal wall 28 as depicted in FIG. 1E.

Figure 4:
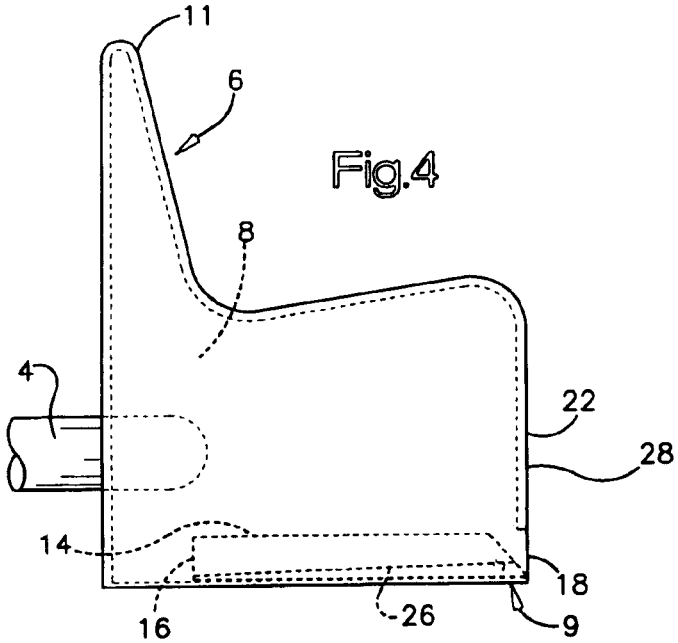
FIG. 4 is a side view of an embodiment of the invention, illustrated with a retractile deck in the closed position.
Figure 5:
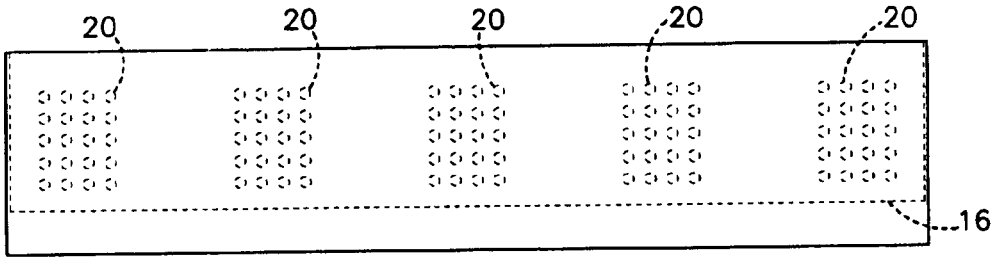
FIG. 5 is a top view of an embodiment of the invention, illustrated with a retractile deck in the closed position.
Figure 6:
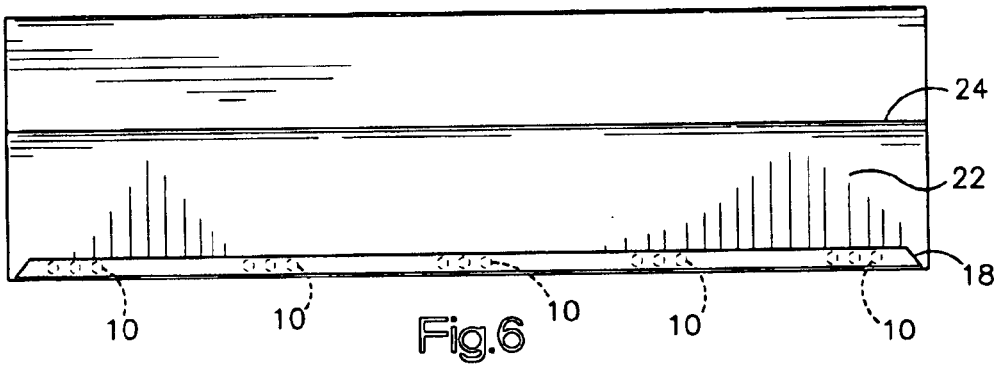
FIG. 6 is a front view of an embodiment of the invention.

The heated, pressurized air is exhausted through the perforations 10 in the base of the frontal wall 28 and into a substantially hollow deck 12. The deck is designed to extend outwardly from the footwall 22 of the bench. The deck has perforations 20 in its top surface 14 through which the heated pressurized air is exhausted from the deck and from the inventive seating device entirely. The deck may be a separate component from the bench, or it may be part of a unibody construction with the bench. It is preferred that that the deck 12 be a separate component which is retractable within the interior space 8 of the bench. FIGS. 4 and 5 illustrate this preferred embodiment of the invention in its closed or retracted position. In the retracted position, the front wall 18 of the deck is flush with and forms a continuous frontal wall 28 (free of perforations) with the footwall 22. In the extended or operable position of the preferred embodiment of the invention, the back wall 16 of the deck is flush and forms a continuous frontal wall 28 with the footwall 22, except for the perforations 10. The perforations 10 are located at the base of the frontal wall 28, the base of the frontal wall being comprised of the back wall 16 of the deck.

It is preferred that the deck 12 have a sloped interior floor 26 so that water condensing in or running into the deck can be drained away from the interior of the deck. Additionally, in the embodiment of deck 6 illustrated in FIGS. 1A–1D, includes a top surface 14 having a plurality of perforations 20. Heated pressurized air is exhausted from the deck via the perforations. Front and side edge portions 86, 87 respectively, extend from the top surface 14 to the ground G. The front and side edge portions 86, 87 are sloped to provide effective drainage and avoid having the deck become a trip hazard. It is also preferred that the retractable deck 12 be entirely removable from the bench 6 so that the interiors of both the bench and the deck are accessible for cleaning. Handles 80 can be used to lift and transport the bench 6. As is disclosed in FIG. 10, the bench can also come equipped with wheels 81 at both ends to also assist in the transport of the bench. In this embodiment, the wheels 81 are capable of being locked into a down position whereby the wheels engage the ground and the bottom of the bench is elevated off of the ground. The wheels 81 may also be locked into an up position whereby the wheels will not be in operation and the bottom of the bench engages the ground.

In every embodiment of the invention disclosed thus far, the operation of the invention has been dependent upon the use of a heat source 2. The invention is operable with any source of pressurized air, however. So although the primary use of the bench and deck is as a total body warmer in cold temperatures, the invention may also be employed as a cooling device in hot environments. This is accomplished through the substitution of an air conditioning unit for the heat source 2 in the operation of the bench and deck. In this embodiment of the invention, cool air is forced into the interior space 8 of the bench 6 and exhausted through the perforations 20 in the deck 12. The cool air entering the interior space 8 of the bench 6 lowers the temperature of the seating surface 24 of the bench 6. The air that is exhausted out of the deck perforations 20 will cool the front side of a person sitting on the bench 6 or fully envelope a person standing on the deck 12. In other words, the invention's basic operation remains constant no matter whether the air source is an air conditioning unit or a heat source—the air source determines the temperature of the surface of the seating device and of the air that is exhausted therefrom.

Although the bench and deck may be constructed from any suitably strong and conductive material, it is preferred that bench and deck be formed from injection molded fiberglass. It is also preferred that the inventive personnel warming system be capable of supporting a total load of 2000 pounds, the load comprising the total weight of any combination of persons sitting or standing on the device.

Figure 10:
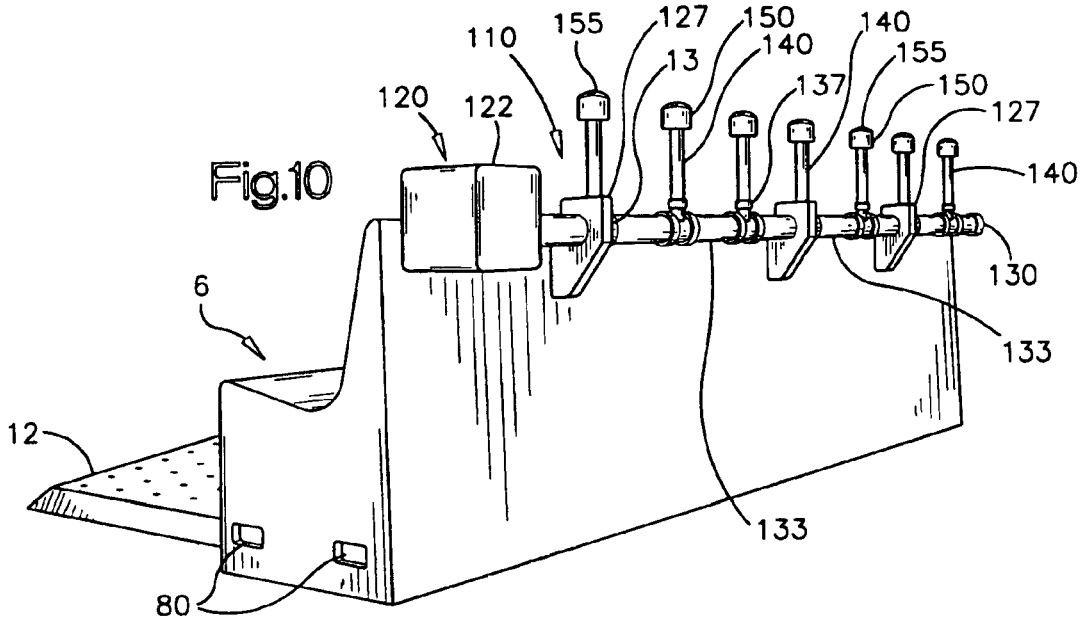
FIG. 10 is a perspective back view of an embodiment of the invention having a helmet heating rack attached thereto.

Referring to FIG. 10, another embodiment of the invention is illustrated. Shown is a bench 6 and deck 12 combination having a helmet heating rack 110 attached thereto. The heating rack 110 is comprised generally of a heating element 120, a generally horizontal hollow duct 130, and a series of generally vertically extending posts 140. Each post 140 has a terminal support 150 upon which a helmet can be placed. And each post 140 also has at least one opening 160 located in the terminal support 150. In the operation of the heating rack 110, heated air generated by the heating element 120 enters the duct 130. The duct 130 is typically a linear structure which is open at only one end. The heated air flows into the duct 130 at one end and then into each of the posts 140 located in spaced relationships along the length of the duct 130. The posts 140 are substantially hollow structures which function as conduits of the heated air. In one embodiment of the invention, the distance between each post 140 on the duct 130 is anywhere in the range from 11 to 12 inches. The heated air is exhausted from the posts 140 through at least one opening 160 located in the terminal support 150 of each of the posts 140. Helmets or other pieces of equipment can be placed on the terminal supports 150 of the posts 140. The heated air exhausted out of the openings 160 then enters the interior space of the helmets and heats their padding. In one embodiment of the invention, the openings 160 are spaced 90° apart around the circumference of the terminal support 150.

Use of heating rack 110 is not limited to heating football or other helmets. The heating rack 110 is capable of use for warming clothing and equipment such as, but not limited to, jackets, jerseys, sweatshirts, sweaters, pants, socks, shoes, hard hats, gloves or any other items that are capable of fitting over or resting on the terminal support 150. Either the heating rack 110 or the bench 6 may be marked with indicia so that a person will know upon which specific terminal support 150 he is supposed to place his own equipment. For instance, the indicia may be a number corresponding to the jersey number of a football player. The indicia will help a player to know where his helmet or other equipment is located when he needs to use it.

The terminal support 150 of the post 140 is the portion of the post 140 that is designed to be located in the interior space of a helmet when a helmet is placed on the heating rack 110. The terminal support 150 is the structure that receives the helmet onto the rack 110 and through which the heated air is delivered to the helmet's padding. To properly accommodate a football helmet or other head-gear, the top surface 155 of the terminal support 150 can be dome-shaped so that it is compatible with the shape of the interior surface of the top of the helmet. As is shown FIG. 11, the terminal support 150 can be comprised of a cap 153 which fits securely over the post 140. In one embodiment of the invention, the cap will be 4 to 4.5 inches in diameter and have a height of 4 to 4.5 inches.

Figure 11:
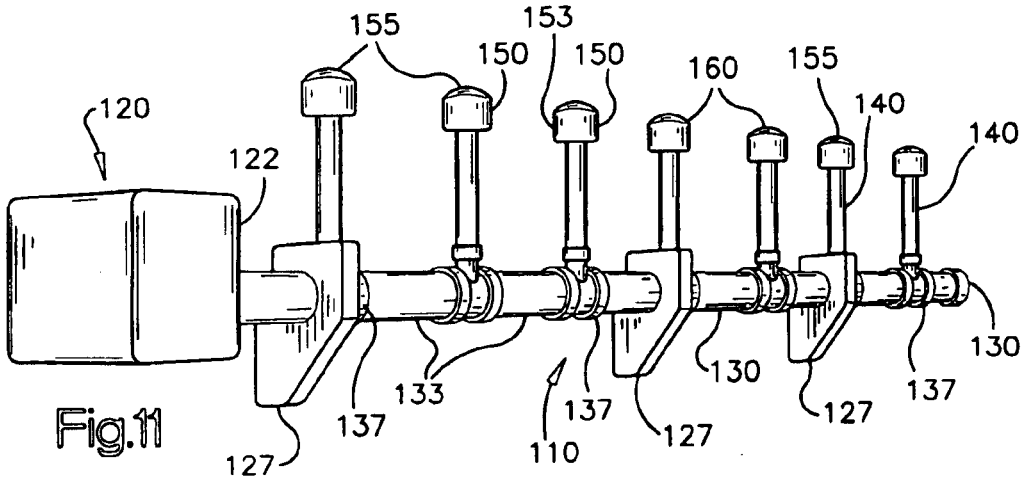
FIG. 11 is a back view of an embodiment of the helmet heating rack portion of the invention.
Figure 12:
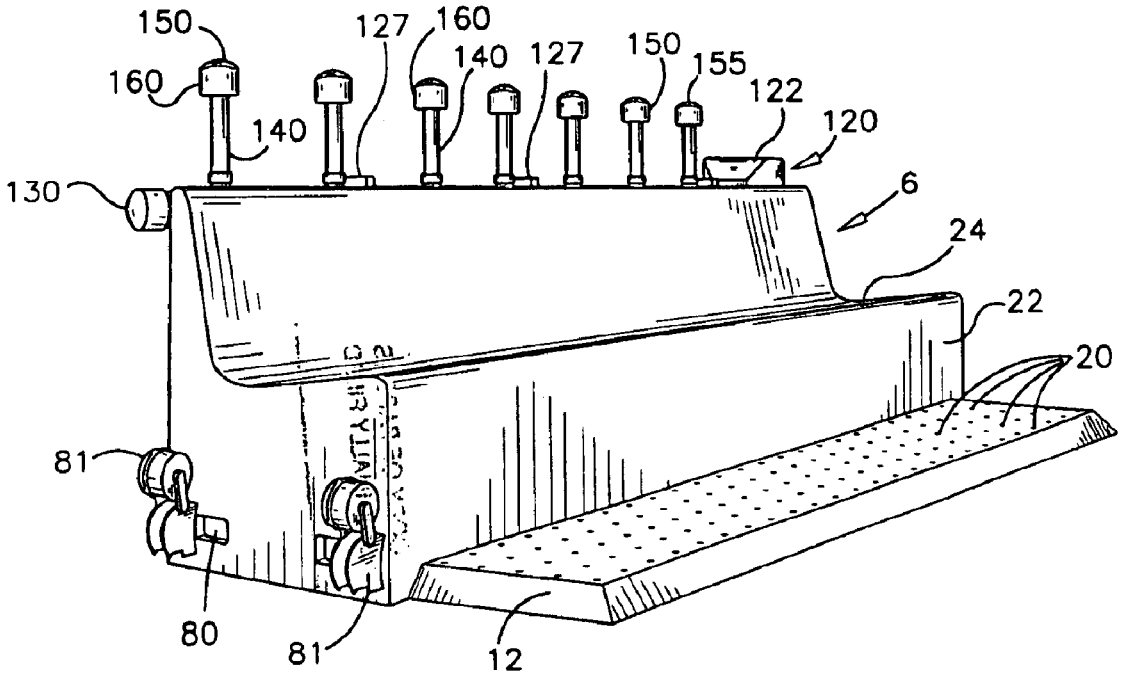
FIG. 12 is a perspective front view of an embodiment of the invention having a helmet heating rack attached thereto.
Figure 13:
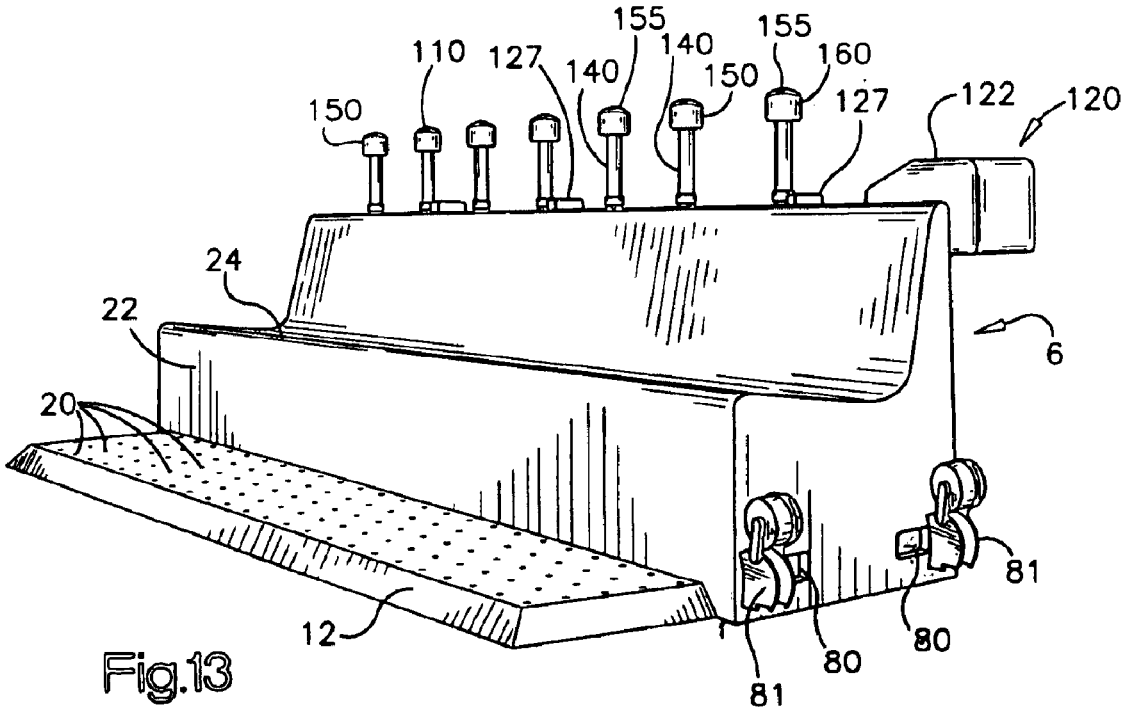
FIG. 13 is a perspective front view of an embodiment of the invention having a helmet heating rack attached thereto and illustrating the opposing perspective view of the device as that illustrated in FIG. 12.
Figure 14:
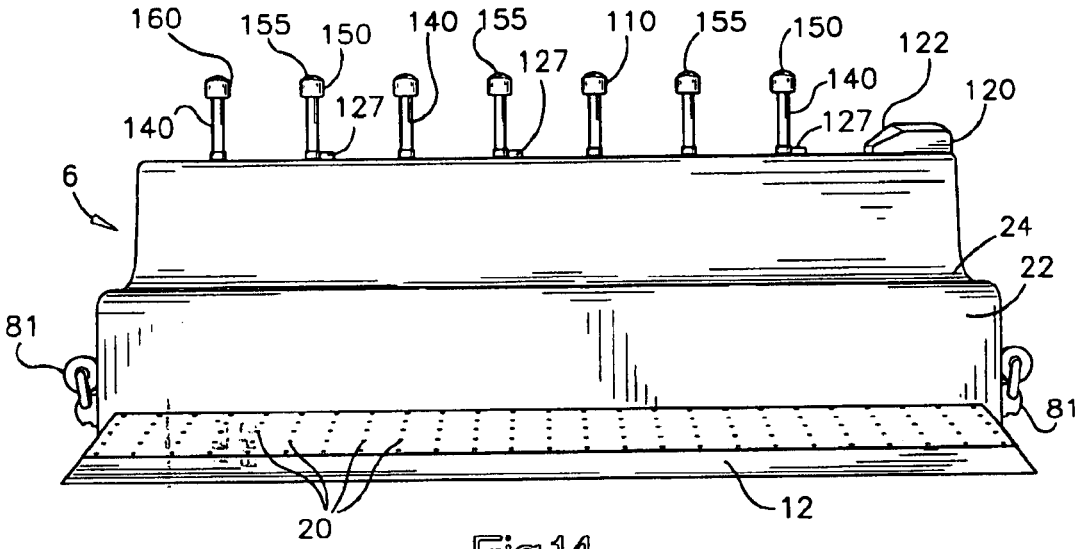
FIG. 14 is a front view of an embodiment of the invention having a helmet heating rack attached thereto.

In the embodiment of the invention illustrated in FIG. 11, the duct 130 is comprised of a series of duct segments 133 that are joined together by tee connectors 137. In this embodiment of the invention, the posts 140 are also joined to the duct 130 by the tee connectors 137. The duct segments 133 and posts 140 can be joined to the tee connectors 137 by threaded engagement or by other known means of mechanical or chemical fastening, such as, but not limited to, screws, nuts and bolts, clamps, welds, or adhesives In another embodiment of the invention, the duct 130, the posts 140 and the terminal supports 150 can comprise a unibody construction, typically made from a mold.

The heating rack 110 can be configured to utilize heated air generated by a variety of known heating devices. For instance, in one embodiment of the invention, the heating element 120 is an electric heater. The basic operation of electric heaters is well known in the art. As the invention is configured in FIG. 11, the electric heater would be housed in a compartment 122 that is connected directly to the duct 130. It is not necessary that the heating element 120 be positioned so that it is directly adjoining or adjacent to the duct 130, however. For example, the electric heater or another heating element 120 can be connected to one or more ducts 130 via an appropriate length of hose or tubing. In another embodiment of the invention, the heating element 120 could be the heat source 2 remotely located from the duct 130 and connected thereto by a hose. Regardless of whether the heating element is positioned in close or remote proximity to the duct 130 however, it is preferred that the heating element 120 be sealingly connected to the duct 130 so that the heated air generated by the heating element is not permitted to escape into the atmosphere before it can enter the duct 130. In addition to electric heaters, heaters fueled by natural gas, kerosene, gasoline or even wood could, for example, be utilized as the heating element 120 for the helmet rack 110. The heating element 120 utilized in connection with the rack 110 should optimally be capable of safely heating air to a temperature range of 75 to 80° F.

It is known to utilize a fan or other blower apparatus in connection with a heater to move the heated air and to increase the area that the heater is effectively able to warm. In that spirit, the heating rack 110 of the present invention may similarly be equipped with a fan or other blower apparatus that forces the air heated by the heating element 120 through the duct 130. In one embodiment of the invention, the electric heater used as the heating element 120 is equipped with a fan. The fan directs the heated air generated by the electric heater into the duct 130. In any embodiment of the invention employing a fan or other blower, the device should be capable directing the heated air through the duct 130 with enough force that the heated air is exhausted out of the openings 160 of every post 140. The electric heater sold by McMaster-Carr Supply Company as Part No. 3092K97, which is equipped with a fan, has been demonstrated to be acceptable as a heating element 120 for use in this invention.

FIG. 10 illustrates an embodiment of the invention wherein the heating rack 110 is shown connected to the inventive bench 6 disclosed herein. In this embodiment, the heating rack 110 is mounted to the bench 6 by a series of support structures 127. To reduce stress on the duct 130, it is preferred that a support structure 127 be attached to the heating rack 110 every 3 to 4 feet along the length of the duct 130. Through the use of different types of support structures 127, the heating rack 110 is capable of being a free-standing device or a device capable of use in combination with other structures. For instance, in an embodiment that utilizes legs as support structures 127, the rack would be free-standing. In another embodiment of the invention, the support structures 127 are brackets. Depending on the orientation of the brackets in relation to the duct 130, the rack 110 can be mounted to a wall or other vertical surface, or to a table or other horizontal surface.

When mounted to a bench 6 as is shown in FIG. 10, it is also possible that the heating rack 110 can utilize the bench 6 as the heating element 120 for the heating rack 110. For this to occur, the support structures 127 would be substantially hollow, and the heated air that is circulating through the bench 6 would be exhausted out of openings in the back of the bench 6 and into the support structure 127. It is preferred that the support structures 127 be sealingly mounted over the openings in the back of the bench 6 to prevent the heated air from escaping into the atmosphere before entering the support structure 127. The hot air would enter the duct 130 from the support structure 127. In this embodiment of the invention, it is possible that the bench and the heating rack comprise an injection-molded unibody construction.

In one embodiment of the invention the duct 130 and the posts 140 are made from poly-vinyl chloride ("PVC"). It is not necessary that the components comprising the helmet heating rack 110 be made from the same material, however. These component can be made from any combination of any material known to be used for conducting air, provided that the material has sufficient strength to support the number of helmets that the rack 110 is designed to hold.

Figure 15:
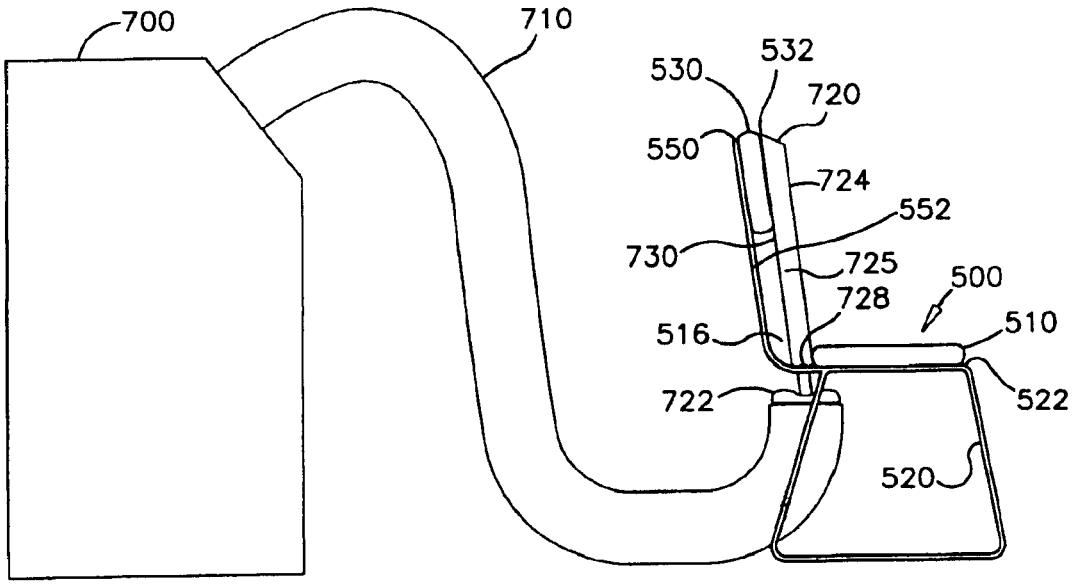
FIG. 15 is a side view of an embodiment of the invention showing a seating device system designed for diffusing cold air.

An embodiment of a seating device, which is particularly useful for cooling seated participants in activities in warm environments is depicted in FIG. 15. In this embodiment, an air conditioning unit 700 is fluidly connected to at least one substantially hollow air diffuser, generally indicated at 720, by a hose 710 or other preferably flexible duct-like structure. The hose 710 is coupled to a manifold 722 provided on the bottom of and in fluid communication with the air diffuser 720. Cold air generated by the air conditioning unit 700 is forced by a blower or the like through the hose 710, through the manifold 722 and into the interior of the substantially hollow air diffuser 720. The cold air is then exhausted through an array of apertures 726, as are depicted in FIG. 16, in the front surface 724 of the air diffuser 720.

Figure 16:
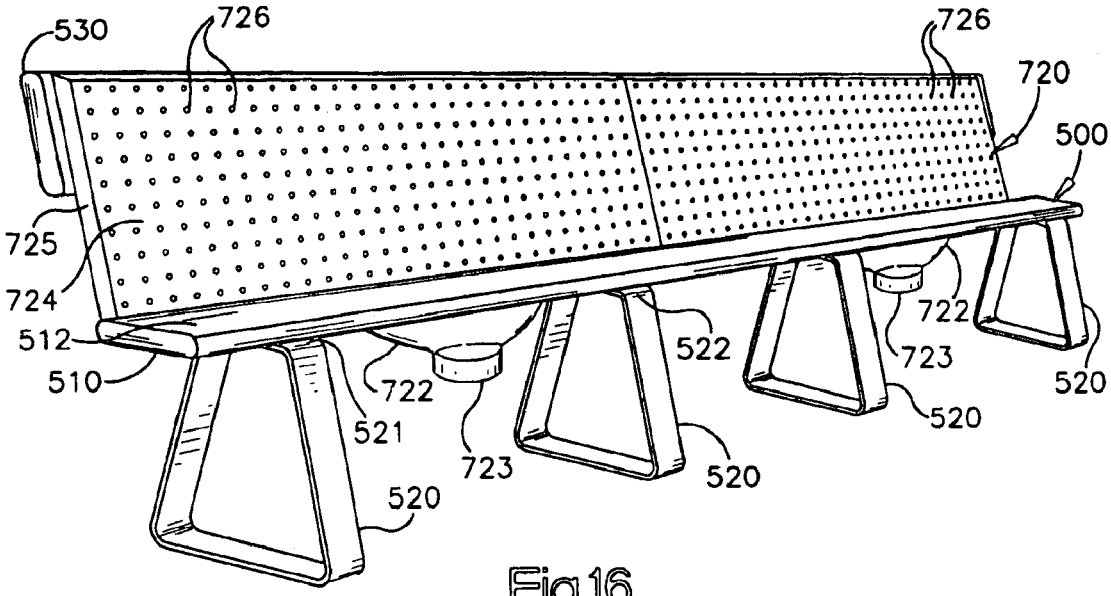
FIG. 16 is a perspective front view of the bench and air diffusers of the embodiment of the invention depicted in FIG. 15.
Figure 17:
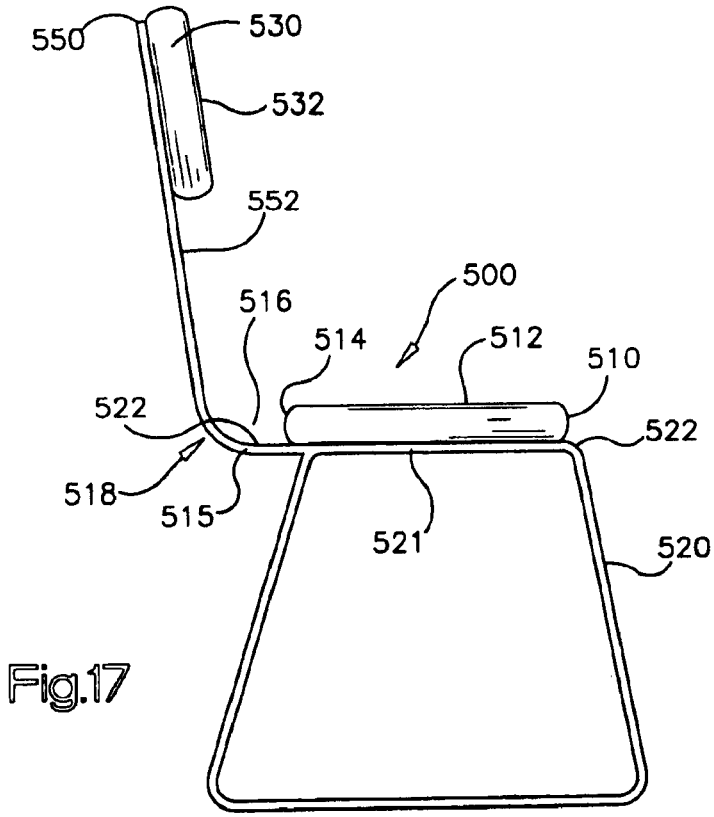
FIG. 17 is a side view of the bench utilized in the embodiment of the invention depicted in FIG. 15.
Figure 18:
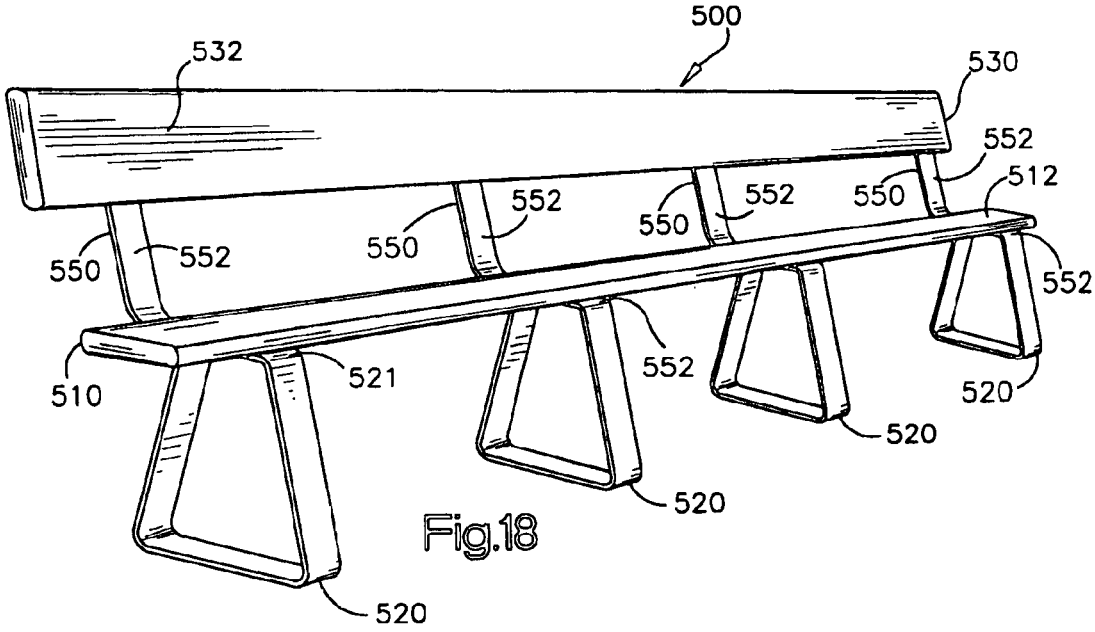
FIG. 18 is a perspective front view of the bench utilized in the embodiment of the invention depicted in FIG. 15.

In operation, the air diffuser 720 can serve as a back rest for a bench, indicated generally at 500, as is shown in FIG. 16. In FIGS. 17 and 18, the bench 500 is shown without the air diffuser 720. This bench embodiment is particularly well suited for use in connection with the air diffuser 720. The bench 500 is supported by a plurality of spaced leg members 520. The bench has a seating member 510 secured to and spanning the top rails 521 of legs 520. The seating member 510 has an upper surface 512 and a back surface 514. The legs 520 may be provided with an integrally formed L-shape support bracket, indicated generally at 518, having a horizontal support 515 and a generally vertically extending brace 550. Alternatively, the L-shape support bracket 518 may be separately formed and secured to either the legs 520 or the seating member 510. A seat back 530 is secured to and extends between the vertical braces 550 of the respective L-shaped support brackets 518.

A channel 516 is defined by the back surface 514 of the seating member 510, the upper surface 522 of the horizontal support 515, and the front surface 552 of the vertical braces 550 of the bench 500. The L-shaped brackets 518 can be an integral part of the leg structures 520 of the bench 500. The seating member 510 rests upon the top rail 521 of each leg 520. The seating member 510 has a depth approximately equal to and generally coincident with the top rails 521 of the legs 520. Thus the upper surface 522 of the horizontal support 515 forms the base of channel 516. While aluminum is preferred for the construction of the bench 500, any suitable material such as wood, fiberglass, steel or plastic may be used.

As is shown in FIG. 15, the air diffuser 720 sits in the channel 516 in such a way that portions of the bottom surface 728 of the air diffuser 720 rest on the upper surface 522 of each horizontal support 515 of the L-shape support bracket 518. A bottom portion of the front surface 724 of the air diffuser 720 engages or abuts the back surface 514 of the seating member 510. As best shown in FIG. 15, a top portion of the back surface 730 of the air diffuser 720 engages the front surface 532 of the back support member 530 of the bench 500. The channel 516 thus acts to securely support and hold the diffuser in a stable position on the bench 500.

Figure 19:
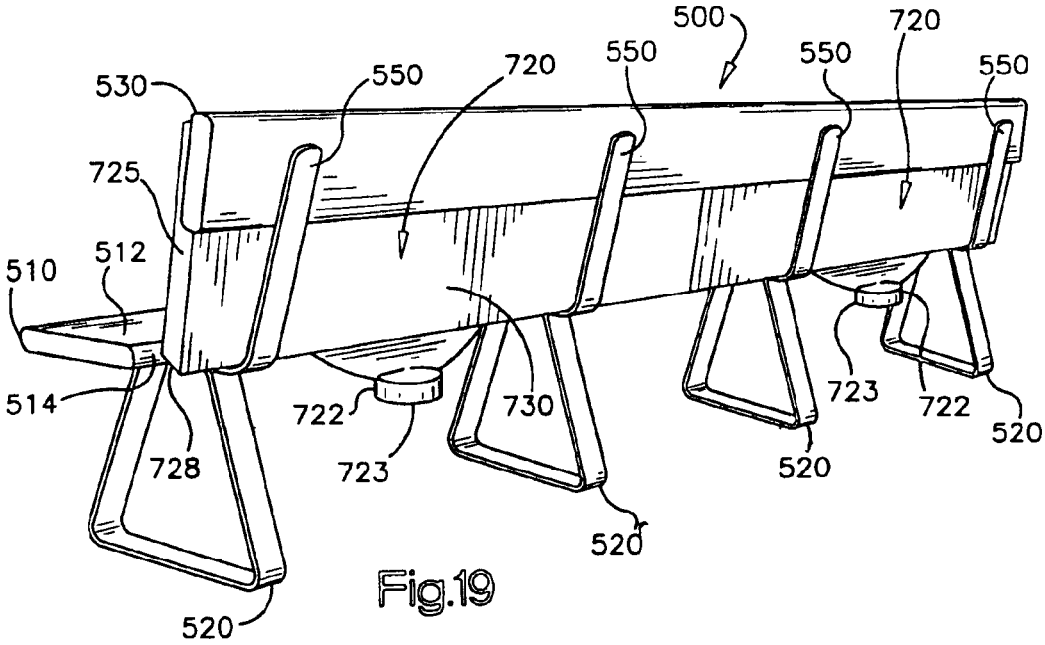
FIG. 19 is a perspective back view of the bench and air diffusers of the embodiment of the invention depicted in FIG. 15.

In one embodiment the bench 500 is 12 feet long, having four legs 520 spaced approximately three feet apart. In this embodiment, two air diffusers 720 six feet in length are placed side by side on the bench 500. As is shown in FIG. 19, this embodiment provides for two L-shape support brackets 518 to support each air diffuser 720. Where an air diffuser 720 sitting securely in channel 516 is supported by at least two L-shape support brackets 518, it is not necessary to secure the air diffuser 720 to the bench 500 by additional fastening means. But when only one L-shape support bracket 518 is present, the air diffuser 720 should be secured to the bench 500 to prevent the air diffuser 720 from pivoting around the single L-shape support bracket. While any known fastening means, such as screws, nuts, bolts, clamps, etc. can be used for the purpose of securing the air diffuser 720 to the bench 500, it is preferred that nylon straps having VELCRO connectors be used to secure the diffuser 720 to the seat back 530 to allow for easy assembly and disassembly of the bench/air diffuser combination.

Each air diffuser 720 will have at least one manifold 722 extending from its bottom surface 728. The width of the manifold 722 is less than the distance between legs 520, allowing end portions of the bottom surface 728 of the air diffuser 720 to rest against the upper surface 522 of horizontal support 515 of L-shape support bracket 518, while the manifold 722 extends downwardly in the space between the legs 520 generally behind the seat member. In an embodiment of the invention where no spaces exist in the horizontal surface 522 large enough to allow the manifold 722 to fit through, the manifold 722 can be attached to one of the side surfaces 725 of the air diffuser to allow the bottom surface 728 to sit flush on the horizontal member 522 and remain parallel to the ground The air diffuser 720 can be made of any suitably durable material, such as injection molded fiberglass. The air diffuser 720 may be molded so that its manifold 722 is part of a single body construction, or the manifold 722 may be a separate piece that is attached to the air diffuser 720 after it is molded. The manifold 722 acts uniformly to distribute the air across the diffuser to establish substantially consistent air flow through all of the apertures 726.

It is preferred that the air diffuser 720 be at least as tall as the distance from the upper surface 522 of the horizontal support portion 515 of L-shape bracket 518 to the top of the back support members 530. It is also preferred that the front surface 724 of the air diffuser be sloped or inclined to the rear as is shown in FIG. 15. The depth of the air diffuser 720 should be less than or equal to the width of the channel 516.

In one embodiment, each six foot long air diffuser 720 is used with an air conditioning unit 700 rated at no less than 12,000 BTUs. The MOVINCOOL® air conditioning unit available from Reliable Construction Heaters, Inc. has been demonstrated to be effective for use in this invention. By having an air conditioning unit 700 of this size and an extensive array of apertures in each diffuser, illustrated as 280 apertures in twenty eight columns of ten apertures each, cold air is directed in a restricted area onto participants seated on the bench 500 to cool their bodies. Although it is preferred to have a single air conditioning unit 700 for each diffuser, the same air conditioning unit 700 can be coupled by hoses 710 to two or even more diffusers 720. It will also be appreciated that a heater with blower can be substituted for the air conditioning unit 700 to blow heated air through the diffusers 720 in cold weather conditions.

While a specific bench has been shown, the air diffuser of the present invention can be used with other benches. For example, in some benches, the diffuser will be supported on the bench seat portion itself and will rest against the seat back. In such example, the manifold will be connected to the side or top of the diffuser unit. Similarly, L-shaped support brackets can be secured to a bench without a back, with the back of the diffuser resting directly against the generally vertically extending braces in such example.

Although this embodiment of the invention is primarily intended to be used in connection with an air conditioning unit, the air conditioning unit may be replaced with a source of heated air to convert the bench/diffuser combination into a heating device. While certain representative embodiments and details have been shown for the purpose of illustrating the invention, it will be apparent to those skilled in the art that various changes and modifications may be made therein without departing from the spirit or scope of the invention.

What is claimed:

1. A seating device comprising:

at least one air conditioning unit fluidly connected to at least one air diffuser; the at least one air diffuser having a bottom surface, a back surface, a front surface, and at least one manifold;

the front surface of the at least one air diffuser having a plurality of apertures; a bench having a seating member, a plurality of legs, a back support member, and a plurality of L-shape brackets, each having a generally horizontal support member and a generally vertically extending brace;

the seating member having a front surface, a top surface, a back surface and a bottom surface, the bottom surface being secured to and spanning the legs to have the seating member assume a generally horizontal plane;

a channel defined by the back surface of the seating member, the generally horizontal support member and front surface of the vertical braces; and the at least one air diffuser occupying the channel such that portions of the bottom surface of the at least one air diffuser abut an upper surface of at least two horizontal support members, a portion of the back surface of the at least one air diffuser abuts a front surface of the back support, and a bottom portion of the front surface of the air diffuser abuts a back surface of the seating member.

2. The seating device of claim 1 wherein the bench further comprises at least three legs and three vertical braces.

3. The seating device of claim 2 further comprising two air diffusers arranged in the channel such that portions of the bottom surface of each air diffuser abut portions of the upper surfaces of two consecutive horizontal support members.

4. The seating device of claim 3 wherein each air diffuser is supported by a portion of at least two vertical braces.

5. The seating device of claim 4 wherein the width of the manifold of each air diffuser is less than the distance between the two consecutive horizontal support members upon which each air diffuser sits and the manifold occupies the space between and beneath the horizontal support members.

6. The seating device of claim 5 wherein the bench comprises four legs and four vertical braces.

7. The seating device of claim 6 wherein the L-shaped support brackets are integrally formed with the legs.

8. A seating device comprising:

a bench having a seat portion and a back portion and spaced L-shaped support brackets secured to the bench, each support bracket having a horizontal member to support a diffuser there above and a generally vertical extending brace to which the back portion is secured;

an air conditioning unit;

at least one substantially hollow air diffuser supported on the bench and forming a back support surface for the bench, the air diffuser having an array of apertures in a surface forming the back support surface;

a conduit fluidly interconnecting the air conditioning unit and the air diffuser permitting relatively cold air sequentially to be forced through the conduit, diffuser and apertures to cool a person seated on the bench.

9. A seating device comprising:

a bench having a seat portion and a back portion and a plurality of spaced leg members supporting the seat portion, the leg members and seat portion defining a space between the leg members for the passage of a diffuser manifold;

an air conditioning unit;

at least one substantially hollow air diffuser supported on the bench and forming a back support surface for the bench, the air diffuser having an array of apertures in a surface forming the back support surface;

a conduit fluidly interconnecting the air conditioning unit and the air diffuser permitting relatively cold air sequentially to be forced through the conduit, diffuser and apertures to cool a person seated on the bench and wherein the diffuser has a manifold on its bottom to which the conduit is fluidly coupled, the manifold acting to distribute the cold air flow across the diffuser.

10. A seating device comprising:

a bench having a seat portion and a back portion;

an air conditioning unit;

at least one substantially hollow air diffuser supported on the bench and forming a back support surface for the bench, the air diffuser having an array of apertures in a surface forming the back support surface;

a conduit fluidly interconnecting the air conditioning unit and the air diffuser permitting relatively cold air sequentially to be forced through the conduit, diffuser and aperture to cool a person seated on the bench and wherein the diffuser has a manifold to which the conduit is fluidly coupled, the manifold acting to distribute the cold air flow across the diffuser and wherein the bench has spaced L-shaped support brackets secured thereon, each support bracket having a horizontal member to support the diffuser there above and a generally vertically extending brace to which the seat back portion is secured.

11. The seating device of claim 10 wherein the manifold is mounted on the bottom of the diffuser and extends through and below the spaces between the L-shaped brackets generally behind the seat portion.

12. The seating device of claim 10 wherein a back surface of the diffuser rests against the seat back portion.

13. The seating device of claim 10 wherein the L-shaped support brackets are integrally formed with spaced legs supporting the bench from the ground.

14. The seating device of claim 10 wherein a bottom front surface of the diffuser abuts against a back of the bench seat portion to stabilize the diffuser position on the bench.

15. The seating device of claim 10 wherein a back surface of the diffuser rests against the generally vertically extending braces of the L-shaped support brackets.

* * * * *